United States Patent [19]

Jacobi, Jr.

[11] Patent Number: 4,727,655

[45] Date of Patent: Mar. 1, 1988

[54] HEAT LAMP ASSEMBLY WITH AIR DUCT

[75] Inventor: Cecil T. Jacobi, Jr., Marshall, Mo.

[73] Assignee: Amjo Infra Red Dryers, Inc., Marshall, Mo.

[21] Appl. No.: 9,495

[22] Filed: Feb. 2, 1987

[51] Int. Cl.[4] ..... F26B 23/04

[52] U.S. Cl. ..... 34/4; 34/41; 34/68

[58] Field of Search ..... 34/4, 41, 68

[56] References Cited

U.S. PATENT DOCUMENTS

| | | | |
|---|---|---|---|
| 2,848,821 | 8/1958 | Clark et al. . | |
| 2,861,354 | 11/1958 | Hultgreen . | |
| 2,896,335 | 7/1959 | Dungler . | |
| 3,256,615 | 6/1966 | Denison et al. . | |
| 3,720,002 | 5/1973 | Martin . | |
| 3,819,929 | 6/1974 | Newman . | |
| 3,950,650 | 4/1976 | Pray et al. . | |
| 3,972,127 | 8/1976 | Hoshi et al. | 34/41 |
| 4,218,830 | 8/1980 | Grassman . | |
| 4,257,172 | 3/1981 | Townsend . | |
| 4,336,279 | 6/1982 | Metzger | 34/41 |
| 4,425,719 | 1/1984 | Klein et al. | 34/156 |
| 4,434,562 | 3/1984 | Bubley et al. . | |
| 4,485,565 | 12/1984 | Ertl et al. . | |

*Primary Examiner*—Larry I. Schwartz

*Attorney, Agent, or Firm*—Litman, McMahon & Brown

[57] ABSTRACT

A heat lamp assembly including a housing with first and second ends and opposite sides. A quartz tube heat lamp is mounted within the housing and extends between its sides. An air bar is also mounted within the housing and extends between its sides in parallel, spaced relation to the heat lamp. The air bar includes inlet and outlet openings and comprises a material with a relatively high coefficient of thermal conductivity for receiving heat from the heat lamp whereby air passing therethrough is warmed.

18 Claims, 9 Drawing Figures

HEAT LAMP ASSEMBLY WITH AIR DUCT

FIELD OF THE INVENTION

The present invention relates generally to heat lamp assemblies, and in particular to a heat lamp assembly with an air duct for drying coated and printed materials.

DESCRIPTION OF THE PRIOR ART

Heat lamp assemblies have heretofore been combined with forced air systems for drying coated and printed materials. For example, the Jacobi et al. U.S. Pat. No. 4,501,072, which is assigned to a common assignee herewith, discloses a dryer for printed materials and the like wherein movable trays of quartz tube heat lamps are employed in conjunction with a forced air system to facilitate the drying of a web of printed materials which moves through the dryer.

Another type of dryer for printed material is shown in the Martin U.S. Pat. No. 3,720,002 and includes radiant heaters mounted within semi-cylindrical reflectors which are attached in a heat exchange relationship to tunnel members. The tunnel members in the Martin device receive air and discharge it onto the printed material through inlets. Exhaust air is collected and recirculated.

An ink curing and drying apparatus is shown in the Pray et al. U.S. Pat. No. 3,950,650 and includes ultraviolet lamp assemblies connected to a forced air system. The forced air, however, is primarily for cooling certain parts of the lamp assemblies.

A combination forced air and infrared dryer is shown in the Townsend U.S. Pat. No. 4,257,172 and includes heaters mounted within semi-cylindrical reflectors and a blower for blowing fresh and recirculated air to a drying zone for a web of printed material.

Infrared quartz tube heat lamps have been found to be particularly well suited for drying the inks and coatings commonly used for printing, particularly high-quality, glossy printing work which involves relatively large amounts of ink and coatings and is done on paper which is generally not as absorbent as, for example, newsprint. The quartz tube infrared heaters preferably emit radiation with wavelengths of about 0.75 to 1.50 microns (short wavelength infrared range) and about 1.50 to 3.00 microns (medium wavelength infrared range). Such quartz tube heat lamps are adaptable to a wide variety of printing press configurations.

In high-quality printing work, large amounts of water and solvents must be evaporated to avoid problems with smearing and offsetting when the finished materials are stacked. Forced air can be used to facilitate the drying and curing process, which can be further hastened by heating the forced air. Since the heat lamps produce a large amount of excess heat which is normally dissipated into the atmosphere, it is desirable to utilize this excess heat to warm the drying air for greater effectiveness, as is done in the Martin drying apparatus discussed above. Furthermore, it is desirable to carefully control the flow of the heated drying air so that uniform drying is achieved.

Although a blower can be added to some existing printing presses and others already include a source of compressed air, forcing the drying air onto the printed material in a uniform manner for maximum effectiveness can be difficult. For example, the Martin apparatus heats the drying air with excess heat from radiant heaters, but the structural arrangement for conveying the drying air to the printed material is substantially more complex than a typical quartz tube heat lamp tray which includes an openbottom enclosure with transversely extending heat lamps and reflectors. Heretofore there has not been available a heat lamp assembly with an air duct and the advantages and features of the present invention.

SUMMARY OF THE INVENTION

In the practice of the present invention, a heat lamp assembly is provided for mounting on a printing press wherein coated and printed materials move from upstream to downstream. The heat lamp assembly includes a housing with upstream and downstream end panels and opposite side panels. A pair of heat lamps are mounted within the housing and extend between the side panels thereof. A reflector is also mounted within the housing and extends between the side panels over the heat lamps. An air bar is mounted on the reflector between the heat lamps and includes opposite ends forming air inlet openings, a center and a plurality of outlet openings. A pair of air baffles each extends from a respective tube end to the tube center. The baffles are adjustable whereby the cross-sectional area of air passages formed through the air tube can be adjusted to achieve desired airflow through the air tube outlet openings.

OBJECTS OF THE INVENTION

The principal objects of the present invention are: to provide a heat lamp assembly for drying coated and printed materials; to provide such a heat lamp assembly which utilizes infrared heat lamps; to provide such a heat lamp assembly which includes an air bar for receiving heat from the heat lamps; to provide such a heat lamp assembly which includes baffles for adjusting the airflow through the air bar; to provide such a heat lamp assembly which is economical to manufacture, efficient in operation, capable of a long operating life and particularly well adapted to the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
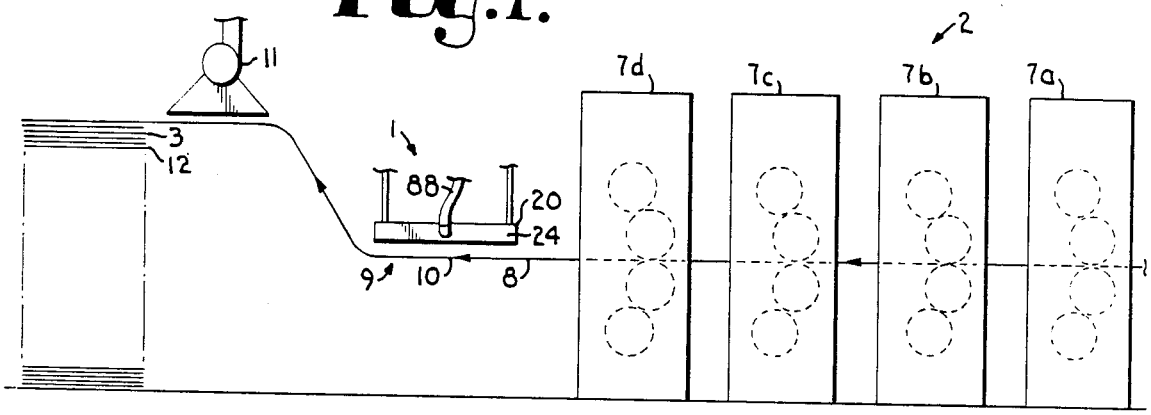
FIG. 1 is an elevational view of a printing press including a heat lamp assembly with an air duct embodying the present invention.
Figure 2:
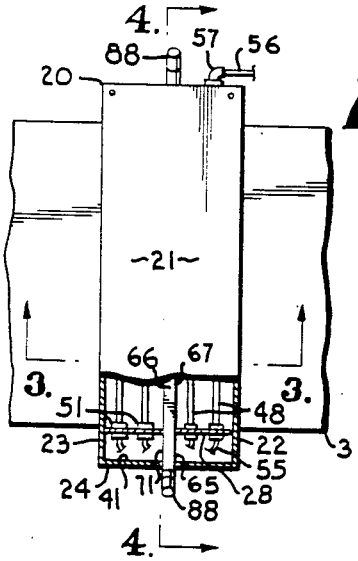
FIG. 2 is a top plan view of the heat lamp assembly.
Figure 5:
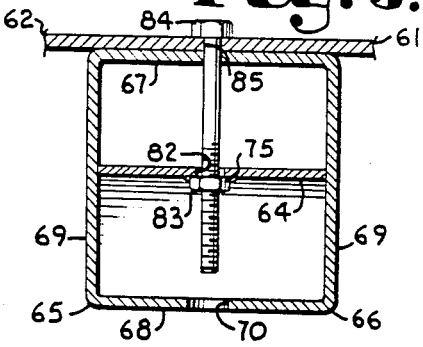
FIG. 5 is a fragmentary, cross-sectional view of the air bar taken generally along line 5—5 in FIG. 4.
Figure 3:
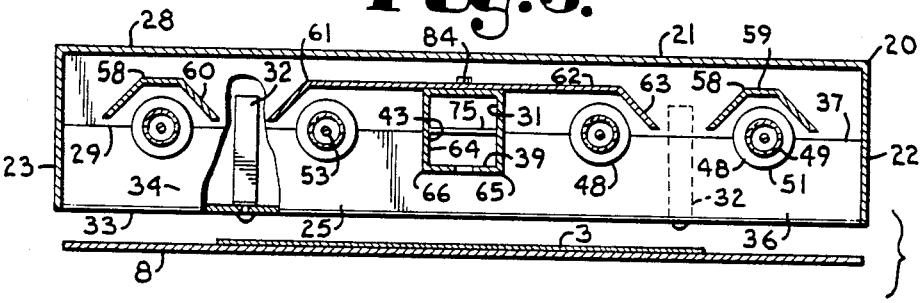
FIG. 3 is a longitudinal, cross-sectional view of the heat lamp assembly taken generally along line 3—3 in FIG. 2.
Figure 4:
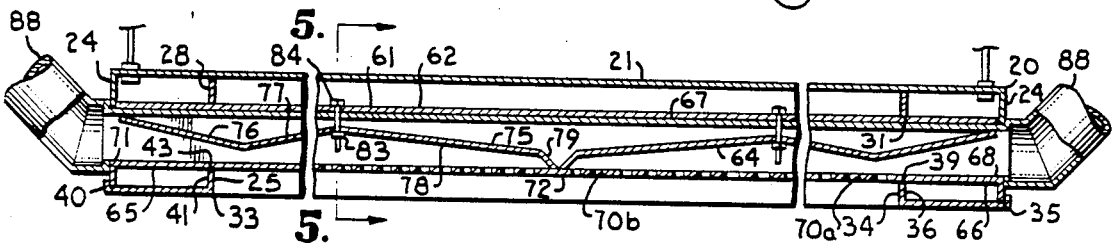
FIG. 4 is a transverse, cross-sectional view of the heat lamp assembly taken generally along line 4—4 in FIG. 2.

Referring to the drawings in more detail, the reference numeral 1 generally designates a heat lamp assembly embodying the present invention and installed on a printing press 2 for printing materials 3 which move therethrough in a direction shown by arrow 4 in FIG. 1. For purposes of disclosing the present invention, "upstream" and "downstream" refer to the right and left respectively in FIG. 1. "Transversely" and "longitudinally" are used with respect to the direction of movement of the printed materials 3. As used herein, "printed materials" include those coated with various types of coatings as well as materials printed with printing inks and the like.

The materials 3 are printed in printing towers *7a, b, c* and *d* and are advanced therefrom by a conveyor 8 to a drying area 9 including an extended delivery section 10 under the heat lamp assembly 1. The materials 3 are then conveyed under an exhaust fan 11 to a printed materials stack 12.

The heat lamp assembly 1 comprises a housing 20 with a top panel 21; upstream and downstream end panels 22, 23; opposite side panels 24 and an open bottom 25. A pair of tube mounting bracket upper halves 28 are connected to and depend downwardly from the top panel 21 in spaced relation from respective side panels 24 and extend between the end panels 22, 23. Each tube mounting bracket upper half 28 includes a lower edge 29 with four semi-circular cutouts (not shown) and a rectangular center cutout 31 open downwardly thereat. A pair of cover plate clips 32 are mounted on and project downwardly from each tube mounting bracket upper half 28.

A pair of cover plates 33 are mounted on the sides of the housing 20 and each includes a tube mounting bracket lower half 36 with an upper edge 37, four semi-circular cutouts (not shown) and a center, rectangular cutout 39 open at the upper edge 37. The tube mounting bracket lower half 36 projects upwardly from an inner end 34 of a respective cover plate 33. A flange 40 projects upwardly from a cover plate outer end 35. When installed on the housing 20, each cover plate 33 is positioned with its tube mounting bracket lower half upper edge 37 against a respective tube mounting bracket upper half lower edge 29 in abutting relation and its flange 40 outside of a respective side panel 24. Junction box enclosures 41 are thereby formed at each end of the housing 20. The opposed pairs of semi-circular cutouts form respective circular cutouts (not shown) and the opposed pairs of rectangular cutouts 31, 39 form square cutouts 43.

A plurality (four are shown) of infrared quartz tube heat lamps 48 extend between the housing side panels 24 and comprise quartz tubes 49 with opposite ends 50 mounting insulators 51. The insulators 51 are received in respective circular cutouts. Nichrome resistance wire heating elements 53 extend through each quartz tube 49 and terminate within the junction box enclosures 41. At one side of the housing 20, pairs of the heating elements 53 are connected by wires 55. At the other side of the housing 20, the heating elements 53 are connected to an electrical supply line 56 which enters a respective junction box enclosure 41 through an elbow 57 at a housing end panel 24. Pairs of the heat lamps 48 are thus connected in series.

A pair of side reflectors 58 are positioned over the outermost heat lamps 48 and each includes a horizontal proximate plate 59 and a pair of distal plates 60 depending outwardly and downwardly therefrom. A center reflector 61 is positioned over the two innermost heat lamps 48 and includes a proximate plate 62 and a pair of distal plates 63 depending outwardly and downwardly therefrom.

A hollow air bar 65 extends transversely through the housing 20 and includes a square tube 66 having top, bottom and side panels 67, 68 and 69, opposite ends 71 and a center 72. The air bar top panel 67 is fastened to the center reflector proximate plate 62 in a heat-exchange relationship therewith. The tube 66 is preferably coated with a radiation-absorbing, nonreflective material, e.g. high temeprature black paint, to maximize radiant heat absorption from the heat lamps 48.

Figure 6:
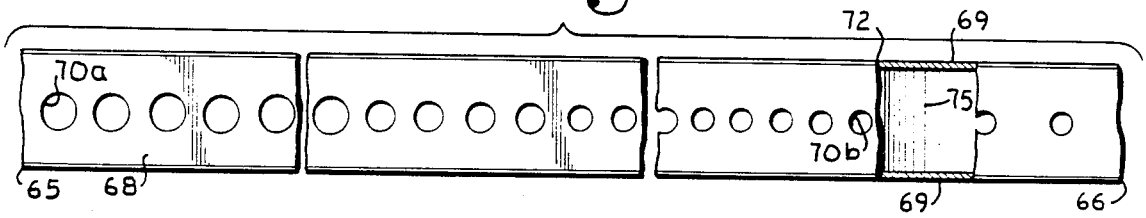
FIG. 6 is a bottom plan view of the air bar.

As shown in FIG. 6, a plurality of outlet openings 70 extend through the tube bottom panel 68 and are aligned therealong. The outlet openings 70 decrease in size from largest openings 70*a* adjacent the ends of the tube 66 to smallest openings 70*b* adjacent the center of the tube 66. The openings 70 are spaced increasingly closer together from the ends 71 of the tube 66 to its center 72.

A pair of baffle plates 75 each extends from a respective tube end 71 to its center 72. A pair of air passages 64 are defined between the baffle plates 75 and the tube bottom panel 68. Each baffle plate 75 includes a first leg 76 which slopes downwardly from the tube top panel 67 adjacent to a respective tube end 71, a second leg 77 which slopes upwardly in a direction toward the tube center 72, a third leg 78 which slopes downwardly toward the tube center 72 and a foot 79 connected to the tube bottom panel 68 at the center 72. An adjustment bolt receiver 82 extends through the baffle plate 75 at the juncture of its second and third legs 77, 78, and aligns with a nut 83 fixedly connected to the baffle plate 75.

An adjustment bolt 84 is rotatably received in the lower adjustment bolt receiver 82 and an upper adjustment bolt receiver 85 which extends through the center reflector proximate plate 62 and the air tube top panel 67. The adjustment bolt 84 is threadably received in the nut 83. The baffle plate 75 has a downward spring bias at the lower adjustment bolt receiver 82 whereby the adjustment bolt 84 is placed in tension. Hence, turning an adjustment bolt 84 either raises or lowers the baffle plate 75 at the juncture between its second and third legs 77, 78 whereby the configuration of the baffle plate 75 and the cross-sectional area of the air passage 64 are altered. The air tube 66 is connected at each end 71 to an air supply duct 88 which communicates with an air source such as a fan or pump.

In operation, the heat lamps 48 are energized and emit radiation in the short and medium wavelength infrared ranges, which is absorbed by the ink and coatings on the printed materials 3 both directly from the heat lamps 48 and indirectly from the reflectors 58, 61. However, a substantial part of the energy emitted by the heat lamps 48 is absorbed by the air bars 65, the reflectors 58, 61 and the housing 20. Thus, the entire heat lamp assembly 1 tends to be relatively hot in operation. The air bar 65, with its flow of cooler air therethrough, functions as a heat sink for the entire heat lamp assembly 1 and receives heat by conduction, convection and radiation. The temperature of the airflow through the air passages 64 is increased by contact with the tube 66 and the baffle plates 75. The outlet openings 70 dispense heated air in a downward direction to the printed materials 3. The heated discharge air tends to dissipate a boundary layer of solvent and moisture laden air immediately above the printed material 3 whereby evaporation of the water and solvents in the ink and coatings is enhanced. Dissipation of the boundary layer also tends to improve the performance of the heat lamps 48, since more of their infrared radiation is thus absorbed by the ink and coatings for more effective drying and curing.

The varying diameters of the outlet openings 70, their spacing, and the adjustable configurations of the baffle plates 75 all cooperate to provide for relatively even airflow from the air bar 65. Lowering the baffle plates 75 tends to restrict the airflow from the center outlet openings 70*b*. Conversely, raising the baffle plates 75 tends to increase the airflow through the center outlet openings 70*b*. By proper adjustment, relatively uniform distribution of airflow can be achieved for various airflow rates through the inlet ducts 88. The adjustability of the airflow can be used to compensate for uneven distribution of the infrared radiation. For example, if greater infrared radiation is received in the middle of the printed materials 3, increasing the airflow from the tube ends 71 with a corresponding decrease in airflow from the tube center 72 can compensate for the uneven radiation distribution and promote even drying and curing.

Figure 7:
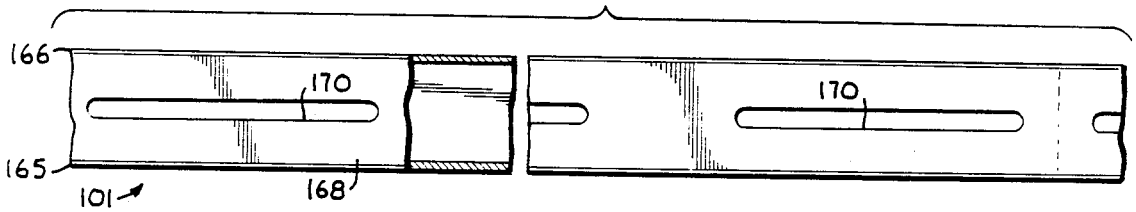
FIG. 7 is a fragmentary, bottom plan view of a heat lamp assembly comprising a first modified embodiment of the present invention.

A heat lamp assembly 101 comprising a first modified embodiment of the present invention is shown in FIG. 7. The first modified heat lamp assembly 101 includes an air bar 165 including a tube 166 with a bottom panel 168 having a plurality of longitudinally aligned slots 170 for outlet openings. The sizes and spacing of the outlet openings 170 is such that relatively uniform airflow from the air bar 165 is achieved.

Figure 8:
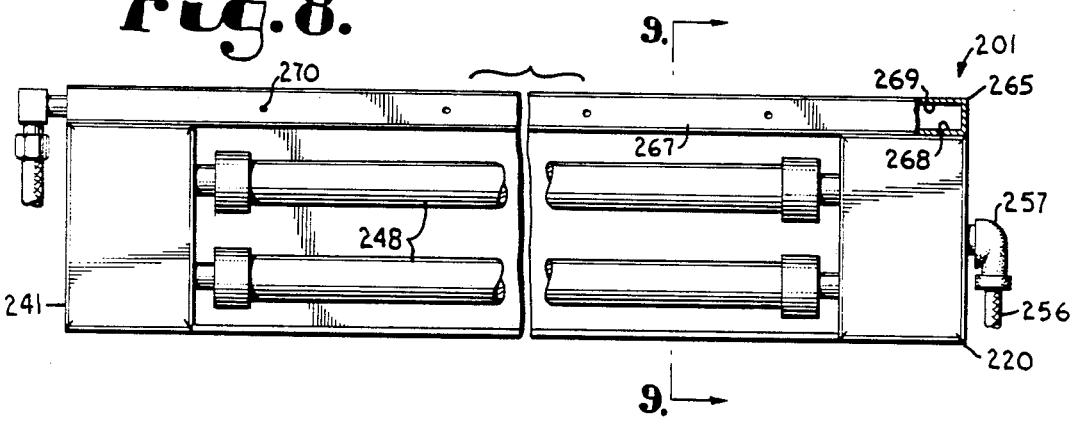
FIG. 8 is a bottom plan view of a heat lamp assembly comprising a second modified embodiment of the present invention.
Figure 9:
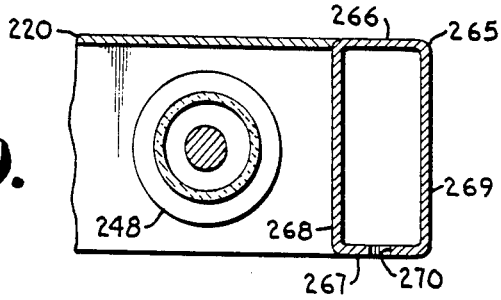
FIG. 9 is a fragmentary, enlarged, cross-sectional view of the second modified heat lamp assembly taken generally along line 9—9 in FIG. 8.

A heat lamp assembly 201 comprising a second modified embodiment of the present invention is shown in FIGS. 8 and 9 and comprises a housing 220 with junction box enclosures 241 at each side thereof and an air tube 265 extending along one end of the heat lamp assembly 201. The air tube 265 includes top, bottom, inside and outside panels 266, 267, 268 and 269. The air tube top panel 266 is part of a top panel of the housing 220. The inside panel 268 separates the air tube 265 from the rest of the housing 220 which receives a pair of quartz tube heat lamps 248. The bottom panel 267 includes a plurality of outlet openings 270 positioned at regularly spaced intervals in longitudinal alignment therealong.

In operation, the temperature of the entire housing 220 is raised when the heat lamps 248 are energized. In particular, the air tube inside panel 268 receives a substantial amount of energy because of its proximity to an adjacent heat lamp 248. The air tube 265 receives airflow from a supply line 256 through an elbow 257. The airflow is warmed by contact with the air tube 265. Preferably, the heat lamp assembly 201 is mounted with the air tube 265 on the upstream end so that the heated air from the air tube tends to disperse the boundary layer of solvents and water vapor from the printed material before it passes under the heat lamps 248.

It is to be understood that while certain forms of the present invention have been illustrated and described herein, it is not to be limited to the specific forms or arrangement of parts described and shown.

What is claimed and desired to be secured by Letters Patent is as follows:

1. A heat lamp assembloy, which comprises:
(a) a reflective housing;
(b) a quartz tube heat lamp mounted within said housing; and
(c) an air tube mounted on said housing in a heat-exchange relationship with said heat lamp and said housing and including inlet and outlet ir openings, said air tube being spaced from said heat lamp.

2. The heat lamp assembly according to claim 1, which includes:
(a) a baffle plate positioned within said air tube and defining an air channel of varying cross-sectional area; and
(b) said inlet and outlet openings communicating air with said air channel.

3. The heat lamp assembly according to claim 1 wherein:
(a) said housing includes first and second ends and opposite sides;
(b) said heat lamp and said air tube extend between said housing opposite sides; and
(c) said air bar is positioned at said first end of said housing.

4. The heat lamp assembly according to claim 2 wherein said air tube includes:
(a) a top panel;
(b) a bottom panel;
(c) an inside panel located within said housing; and
(d) an outside panel located at said housing first end.

5. The heat lamp assembly according to claim 4, which includes:
(a) a plurality of said outlet openings in said air tube bottom panel.

6. The heat lamp assembly according to claim 4 wherein:
(a) said housing includes a top panel including said air tube top panel.

7. A heat lamp assembly, which comprises:
(a) a housing;
(b) a quartz tube heat lamp mounted within said housing;
(c) an air tube mounted within said housing in a heat-exchange relationship with said heat lamp and including inlet and outlet air openings, said air tube extending in parallel, spaced relation with respect to said heat lamp;
(d) said housing having opposite sides with said heat lamp and said air tube extending therebetween;

(e) a reflector mounted within said housing and extending between the sides thereof over said heat lamp and said air tube; and (f) said air tube being mounted on said reflector in a heat-exchange relationship therewith.

8. The heat lamp assembly according to claim 7 wherein;

(a) said reflector includes a proximate plate and a pair of distal plates extending outwardly and downwardly from said proximate plate; and (b) said air tube is mounted on said proximate plate.

9. A heat lamp assembly, which comprises:

(a) a housing including first and second ends and opposite sides;

(b) a quartz tube heat lamp mounted within said housing and extending between the sides thereof; and (c) an air bar mounted within said housing and extending between the sides thereof in parallel, spaced relation from said heat lamp, said air bar including;

(1) a tube with opposite ends each connected to a respective housing side;

(2) a baffle plate positioned within said tube and defining an air chanel of varying crosssectional area;

(3) an inlet opening in said tube communicating air with said air channel;

(4) an outlet opening in said tube communicating air with said air channel; and (5) means for adjusting the position of said baffle plate within said tube whereby the cross-sectional area of said air channel is adjustable.

10. The heat lamp assembly according to claim 9, which includes:

(a) a reflector mounted within said housing and extending between the sides thereof over said heat lamp.

11. The heat lamp assembly according to claim 9, which includes:

(a) said tube having:

(1) opposite ends;

(2) a center;

(3) a top panel;

(4) a bottom panel; and (5) opposite side panels; and (b) a pair of said baffle plates each having:

(1) a first leg extending downwardly towards said tube center from said top plate in proximity to a respective tube end;

(2) a second leg extending upwardly towards said tube center;

(3) a third leg extending downwardly towards said tube center; and (4) a foot extending from said third leg to said bottom plate in proximity to said tube center.

12. The heat lamp asssembly according to claim 11 wherein said adjustment means comprises:

(a) a pair of lower adjustment bolt receivers each in a respective baffle plate at a juncture between said second and third legs thereof;

(b) a pair of nuts each fixedly mounted on a respective baffle plate in alignment with said lower adjustment bolt receiver;

(c) a pair of upper adjustment bolt receivers each in said tube top panel; and (d) a pair of adjustment bolts each rotatably received in respective upper and lower adjustment bolt receivers and threadably received in a respective nut.

13. A heat lamp assembly, which comprises:

(a) a housing including first and second ends and opposite sides;

(b) a quartz tube heat lamp mounted within said housing and extending between the sides thereof; and (c) an air bar mounted within said housing and extending between the sides thereof in parallel, spaced relation from said heat lamp, said air bar including:

(1) a tube with opposite ends each connected to a respective housing side;

(2) a baffle plate positioned within said tube and defining an air channel of varying cross-sectional area;

(3) an inlet opening in said tube communicating air with said air channel; and (4) an outlet opening in said tube communicating air with said air channel.

14. The heat lamp assembly according to claim 13 wherein:

(a) said reflector includes a proximate plate and a pair of distal plates extending outwardly and downwardly from said proximate plate; and (b) said air bar is mounted on said proximate plate.

15. The heat lamp assembly according to claim 13, which includes:

(a) a plurality of said outlet openings each comprising a slot extending longitudinally with said tube.

16. A heat lamp assembly, which comprises:

(a) a housing including first and second ends and opposite sides;

(b) a quartz tube heat lamp mounted within said housing and extending between the sides thereof; and (c) an air bar mounted within said housing and extending between the sides thereof in parallel, spaced relation from said heat lamp, said air bar including:

(1) a tube with opposite ends each connected to a respective housing side;

(2) a baffle plate positioned within said tube and defining an air channel of varying cross-sectional area;

(3) an inlet opening in said tube communicating air with said air channel; ano (4) an outlet opening in said tube communicating air with said air channel;

(5) said tube having opposite ends each with a respective said inlet opening thereat;

(6) said tube having a center; and (7) said tube having a plurality of said outlet openings in longitudinally-aligned relation, said outlet openings having diameters varying from the largest in proximity to said tube ends of the smallest in proximity to said tube center.

17. A heat lamp assembly, which comprises:

(a) a housing including first and second ends and opposite sides;

(b) a pair of quartz tube heat lamps mounted within said housing and extending between the sides thereof;

(c) an air bar mounted within said housing and extending between the sides thereof in parallel, spaced relation between said heat lamps, said air bar including:

(1) a tube with opposite ends each connected to a respective housing side;

(2) a baffle plate positioned within said tube and defining an air channel of varying cross-sectional area;

(3) an inlet opening in said tube communicating air with said air channel; and (4) an outlet opening in said tube communicating air with said air channel;

(d) a reflector extending between said housing sides and positioned over said heat lamps and said air bar.

18. In a printing press having a delivery conveyor for printed or coated materials, the improvement of a heat lamp assembly mounted over said conveyor transverse to its path of movement, which comprises:

(a) a housing with a top panel, first and second end panels, opposite side panels, an open bottom and a pair of junction box enclosures each adjacent to a respective side panel;

(b) a pair of quartz tube heat lamps each extending between said junction box enclosures within said housing;

(c) a reflector positioned within said housing and extending between said junction box enclosures, said reflector including a proximate plate substantially parallel to said housing top panel and a pair of distal plates extending outwardly and downwardly therefrom, said heat lamps being located under said reflector;

(d) an air bar including:

(1) a square tube with top, bottom and side panels, said air tube top panel being connected to said reflector proximate plate in a heat-exchange relationship therewith;

(2) said tube having opposite ends and a center and being adapted to receive inlet air at said tube ends;

(3) said tube bottom having a plurality of longitudinally-aligned outlet openings of varying diameters ranging from largest diameters in proximity to said tube ends to smallest diameters in proximity to said tube center;

(4) a pair of baffle plates each extending between a respective tube end and said tube center and each including a first leg extending downwardly towards said tube center from said top plate adjacent a respective tube end, a second leg extending upwardly towards said tube center, a third leg extending downwardly towards said tube center and a foot extending from said third leg to said bottom plate adjacent said tube center;

(5) each said baffle plate having a lower adjustment bolt receiver extending therethrough at a juncture between said second and third legs thereof and a nut fixedly mounted on said baffle plate in alignment with said lower adjustment bolt receiver;

(6) a pair of upper adjustment bolt receivers each extending through said tube top panel and said reflector proximate plate in alignment with a respective lower adjustment bolt receiver;

(e) a pair of adjustment bolts each rotatably received in respective upper and lower adjustment bolt receivers and threadably received in a respective nut; and (f) each said adjustment bolt being adapted to vary a cross-sectional area of a respective air passage extending from a respective tube end to said tube center between said tube bottom panel and a respective baffle plate.

* * * * *